US009802137B2

(12) United States Patent
Yang

(10) Patent No.: US 9,802,137 B2
(45) Date of Patent: Oct. 31, 2017

(54) FLYING TOY

(71) Applicant: GENIUS TOY TAIWAN CO., LTD., Taichung (TW)

(72) Inventor: Yiming Yang, Taichung (TW)

(73) Assignee: GENIUS TOY TAIWAN CO., LTD., Taichung (TW)

( * ) Notice: Subject to any disclaimer, the term of this patent is extended or adjusted under 35 U.S.C. 154(b) by 0 days.

(21) Appl. No.: 15/178,127

(22) Filed: Jun. 9, 2016

(65) Prior Publication Data

US 2017/0203224 A1 Jul. 20, 2017

(30) Foreign Application Priority Data

Jan. 20, 2016 (TW) ..... 105101624 A

(51) Int. Cl.
*A63H 27/00* (2006.01)
*A63H 29/18* (2006.01)

(52) U.S. Cl.
CPC ..... *A63H 27/008* (2013.01); *A63H 29/18* (2013.01)

(58) Field of Classification Search
CPC ..... A63H 27/008; A63H 29/18; A63H 31/08; A63H 27/00; A63H 27/02; A63H 31/00; A63F 2009/2482
USPC ..... 446/35, 36, 37, 39, 44, 58, 59, 61, 62
See application file for complete search history.

(56) References Cited

U.S. PATENT DOCUMENTS 262,686 A * 8/1882 Myers ..... A63H 27/008 185/DIG. 1
2,814,907 A * 12/1957 Sears ..... A63H 27/008 446/35
5,163,861 A * 11/1992 Van Ruymbeke ... A63H 27/008 244/11
6,200,192 B1 * 3/2001 Hou ..... A63H 3/20 446/352
6,632,119 B2 * 10/2003 Chernek ..... A63H 29/18 244/72
6,645,034 B1 * 11/2003 Tsai ..... A63H 13/12 40/418
7,651,051 B2 * 1/2010 Agrawal ..... B64C 33/02 244/22
8,382,546 B2 * 2/2013 Van Ruymbeke ... A63H 27/008 244/11
2002/0065015 A1 * 5/2002 Chernek ..... A63H 29/18 446/34
2002/0173217 A1 * 11/2002 Kinkade ..... B64C 33/02 446/35
2006/0049306 A1 * 3/2006 Kim ..... A63H 30/04 244/72

(Continued)

*Primary Examiner* — Vishu Mendiratta
(74) *Attorney, Agent, or Firm* — The Mueller Law Office, P.C.

(57) ABSTRACT

A flying toy includes a left sector gear, a left wing connector extending radially from the left sector gear, a right sector gear, a right wing connector extending radially from the right sector gear, a drive shaft, a crank piece mounted on the drive shaft to rotate therewith, a crank arm coupled between the crank piece and one of the left and right sector gears, two wing members connected respectively to the left and right wing connectors, and a drive unit configured to drive the drive shaft. The right sector gear is configured to mesh with the left sector gear so as to synchronize up-and-down movement of the left and right wing connectors to thereby result in a flapping motion of the two wing members.

16 Claims, 12 Drawing Sheets

(56) References Cited

U.S. PATENT DOCUMENTS

2011/0079677 A1* 4/2011 Chronister ..... A63H 27/008
244/11

* cited by examiner

FLYING TOY

CROSS-REFERENCE TO RELATED APPLICATION

This application claims priority from Taiwanese patent application no. 105101624, filed on Jan. 20, 2016.

FIELD

The disclosure relates to a flying toy, more particularly to a flying toy driven by a rubber band powered motor.

BACKGROUND

With reference to FIGS. 1 and 2, a conventional flying toy disclosed in European patent no. 2349516 B1 includes a support structure (not shown), a wing actuating mechanism 1, a first flexible wing 16, and a second flexible wing 17. The wing actuating mechanism 1 includes a drive crank 12 mounted rotatably on amounting seat 11 that is mounted on one end of the support structure. The first and second flexible wings 16, 17 are connected, firstly, at first and second wing roots 161, 171 to the wing actuating mechanism 1 and secondly to the other end of the support structure. The first and second wing roots 161, 171 are mounted on the mounting seat 11 so that the first and second wing roots 161, 171 oscillate about axles 111, 112, respectively. An internal end of the first wing root 161 is extended by a guideway 13 in which a wrist 121 of the drive crank 12 is mounted as a sliding pivot connection so that the rotation of the drive crank 12 causes the first wing root 161 to oscillate back and forth about the axle 111. The first wing root 161 has a first gear 14 driving a second gear 15 arranged on the second wing root 171. The first gear 14 is configured to mesh with the second gear 15 such that the first and second wing roots 161, 171 oscillate back and forth symmetrically about their respective axles 111, 112.

However, in operation, a friction resistance between the wrist 121 of the crank 12 and the guideway 13 is relatively large, which may adversely affect the flying ability of the flying toy.

SUMMARY

Therefore, an object of the disclosure is to provide a novel flying toy in which a crank piece and a crank arm are provided for transmitting a drive force to left and right sector gears to thereby enhance the flying ability of the flying toy.

According to a first aspect of the disclosure, a flying toy includes a support frame, a left sector gear, a left wing connector, a right sector gear, a right wing connector, a drive shaft, a crank piece, a crank arm, two wing members, and a drive unit. The support frame has a forward end segment and a rearward end segment opposite to the forward end segment in a longitudinal direction. The forward end segment has a left region and a right region opposite to the left region in a transverse direction transverse to the longitudinal direction. The left sector gear is mounted pivotally on the left region about a left axis in the longitudinal direction, and has a left toothed segment. The left wing connector is disposed on the left sector gear and extends radially relative to the left axis such that when the left sector gear turns clockwise or counterclockwise about the left axis, the left wing connector moves upward or downward, respectively. The right sector gear is mounted pivotally on the right region about a right axis parallel to the left axis, and has a right toothed segment.

The right wing connector is disposed on the right sector gear and extends radially relative to the right axis such that when the right sector gear turns clockwise or counterclockwise about the left axis, the right wing connector moves downward or upward, respectively. The drive shaft defines a shaft axis parallel to the left axis, and is rotatably mounted on the forward end segment. The crank piece has a crank region which is configured to be mounted on the drive shaft to rotate therewith about the shaft axis, and a connecting region which is radially offset from the shaft axis. The crank arm has a downward end segment configured to be pivotally coupled to the connecting region, and an upward end segment configured to be pivotally coupled to one of the left and right sector gears at a position proximate to a corresponding one of the left and right toothed segments. Each of the two wing members is connected to a corresponding one of the left and right wing connectors. The drive unit is configured to drive the drive shaft to rotate about the shaft axis. The right toothed segment is configured to mesh with the left toothed segment so as to synchronize up-and-down movement of the left and right wing connectors to thereby result in a flapping motion of the two wing members.

According to a second aspect of the disclosure, a flying toy includes a support frame, a transmission mechanism, a wing unit, and a drive unit. The support frame has a first region and two second regions disposed at two sides of the first region. The transmission mechanism is disposed on the support frame and includes a crank piece, a first gear, a second gear, and a crank arm. The crank piece is rotatably coupled on the first region. The first and second gears are rotatably coupled on the second regions, respectively, and are meshed together. The crank arm has two opposite end segments which are pivotally coupled to the second gear and the crank piece, respectively. The wing unit includes two wing members which are respectively coupled to the first and second gears. The drive unit is disposed in the support frame and is configured to drive the crank piece to rotate such that when the second gear is driven by the crank arm to rotate in one of clockwise and counterclockwise directions, the first gear is driven by the second gear to rotate in the other one of clockwise and counterclockwise directions, thereby synchronizing a flapping motion of the two wing members.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
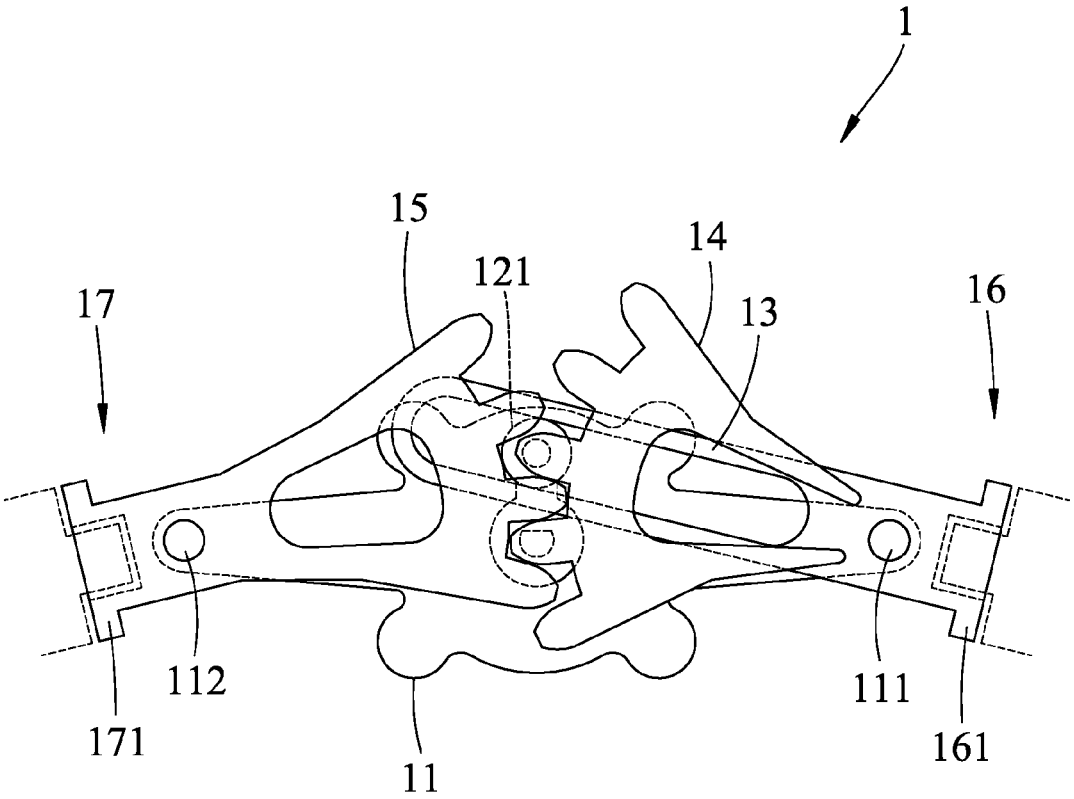
FIG.1 PRIOR ART
FIG. 1 is a front view of a wing actuation mechanism of a conventional flying toy.
Figure 2:
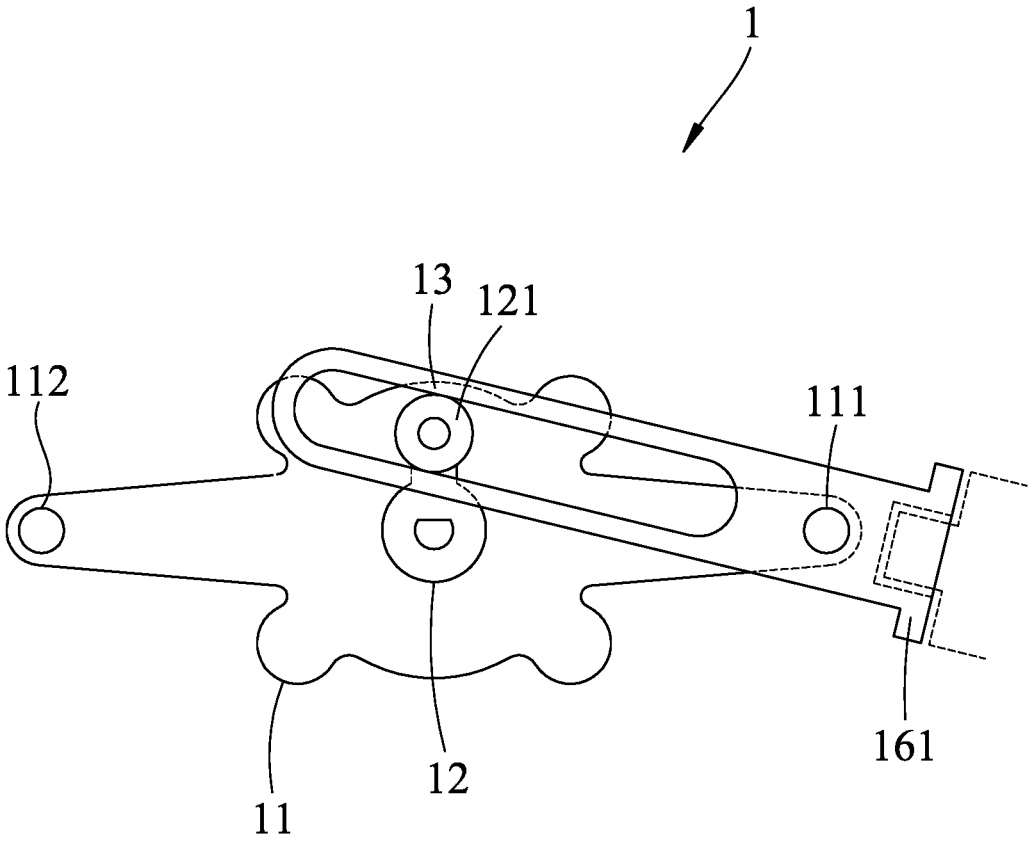
FIG.2 PRIOR ART
FIG. 2 is similar to FIG. 1 except that first and second gears are omitted.

Before the present invention is described in greater detail, it should be noted herein that same reference numerals are used to denote like elements throughout the specification.

Figure 3:
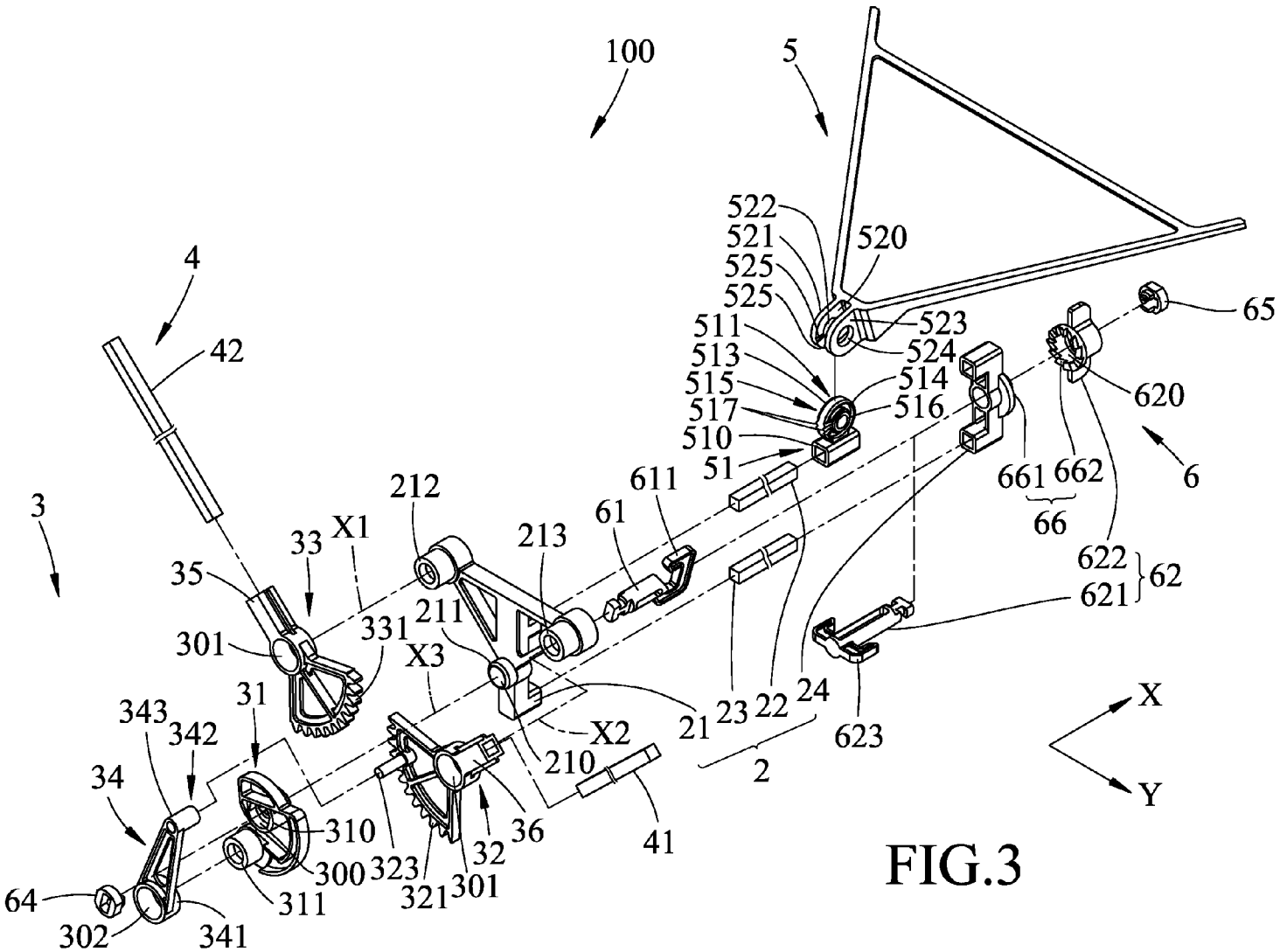
FIG. 3 is an exploded perspective view of a flying toy according to a first embodiment of the disclosure.

With reference to FIG. 3, a flying toy 100 according to a first embodiment of the disclosure is shown to include a support frame 2, a transmission mechanism 3, a drive shaft 61, a wing unit 4, a tail fin 5, and a drive unit 6.

The support frame 2 has a forward end segment 21 and a rearward end segment 24 opposite to the forward end segment 21 in a longitudinal direction (X). The forward segment 21 has a first region (i.e., a shaft region 211) and two second regions (i.e., a left region 212 and a right region 213) disposed at two sides of the first region 211. The right region 213 is opposite to the left region 212 in a transverse direction (Y) transverse to the longitudinal direction (X). In this embodiment, the support frame 2 further has two elongated support bars 22, 23 each connecting the forward end segment 21 and the rearward end segment 24. The shaft region 211 is disposed downwardly of the left and right regions 212, 213. A distance between the shaft region 211 and the left region 212 is substantially the same as a distance between the shaft region 211 and the right region 213.

The drive shaft 61 defines a shaft axis (X3) and is rotatably mounted on the forward end segment 21. In this embodiment, the drive shaft 61 extends through the shaft region 211 of the forward end segment 21.

Figure 4:
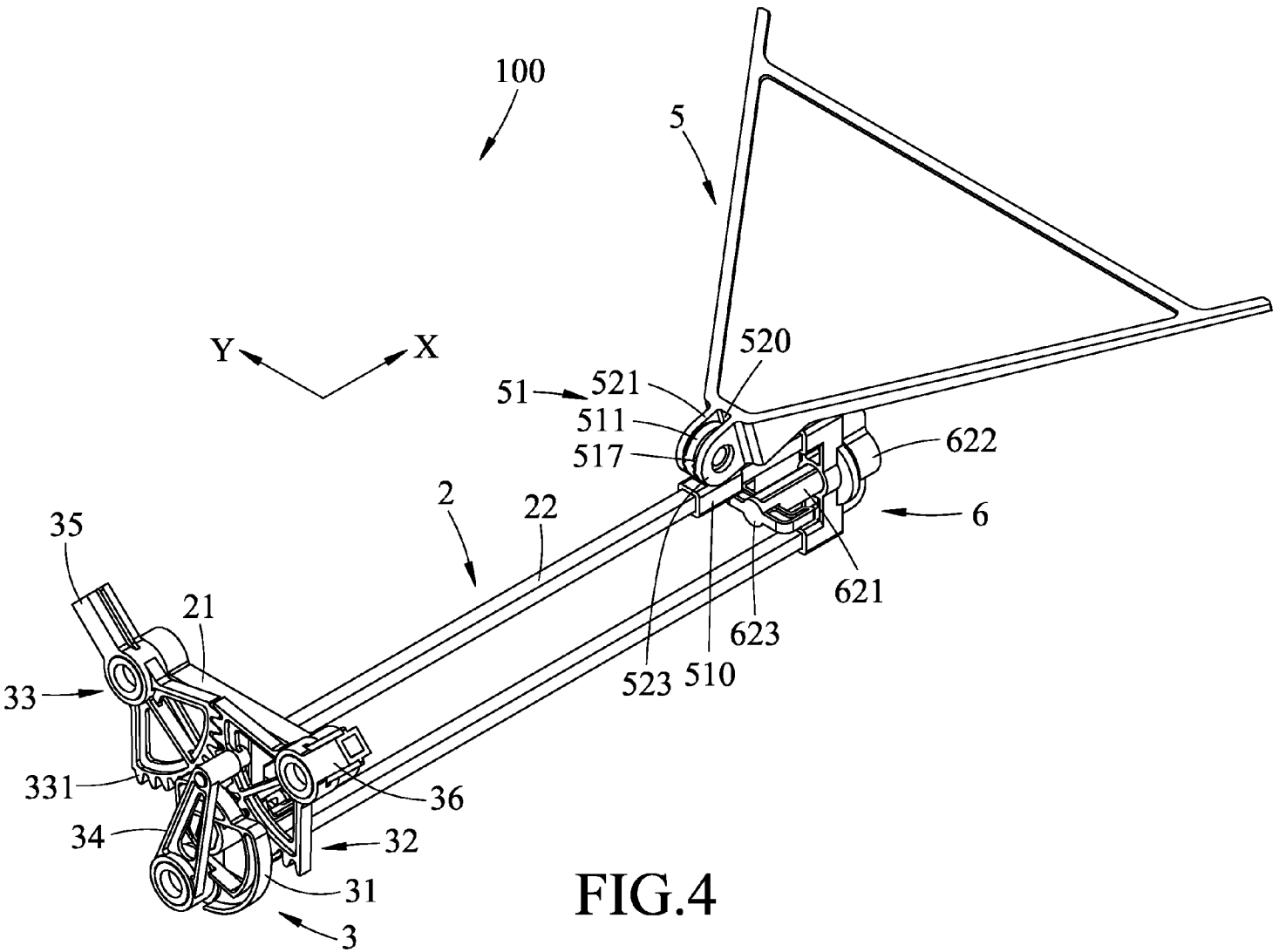
FIG. 4 is a front perspective view of the flying toy according to the first embodiment of the disclosure.
Figure 5:
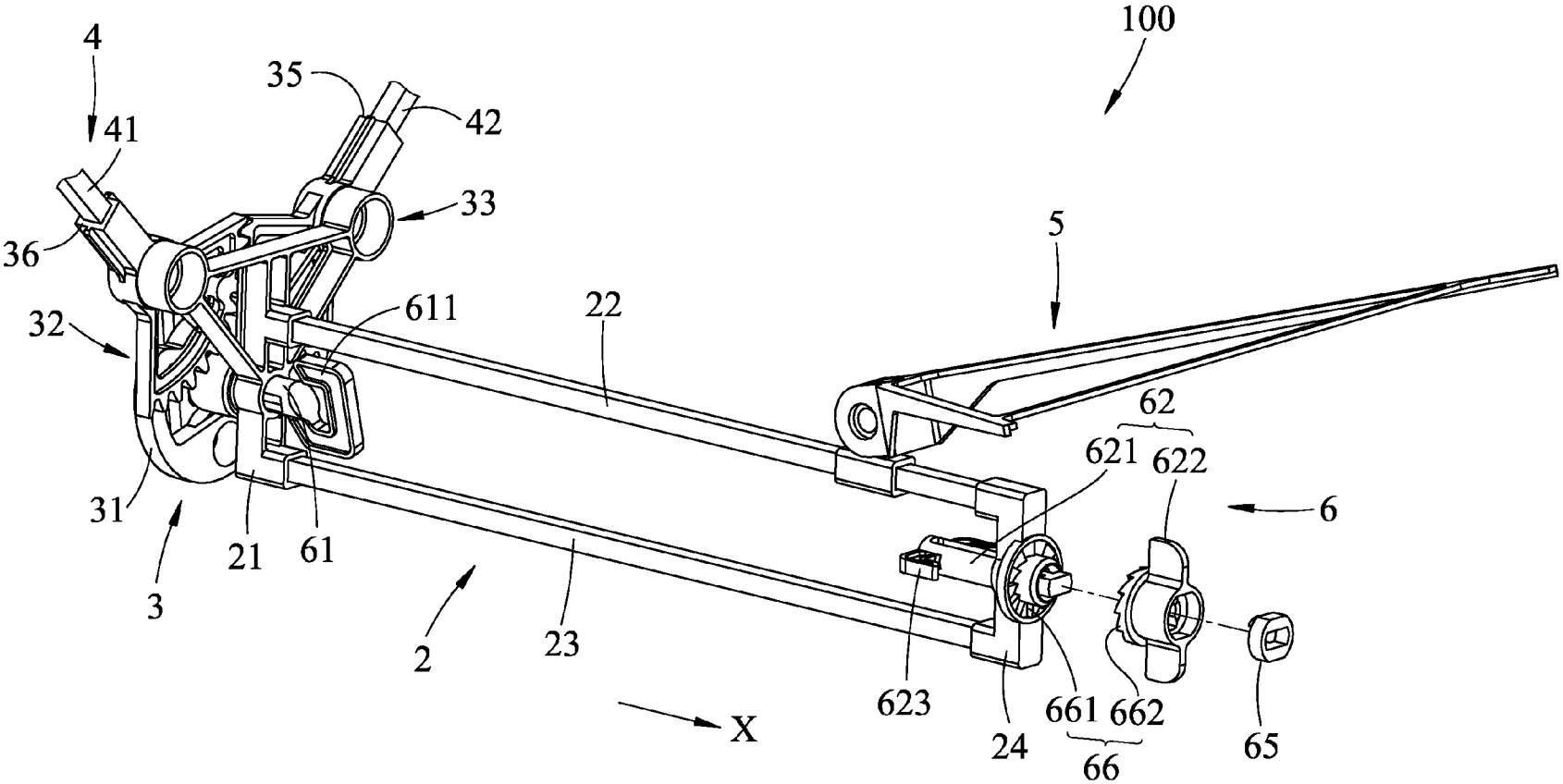
FIG. 5 is a rear perspective view of the flying toy according to the first embodiment of the disclosure.
Figure 6:
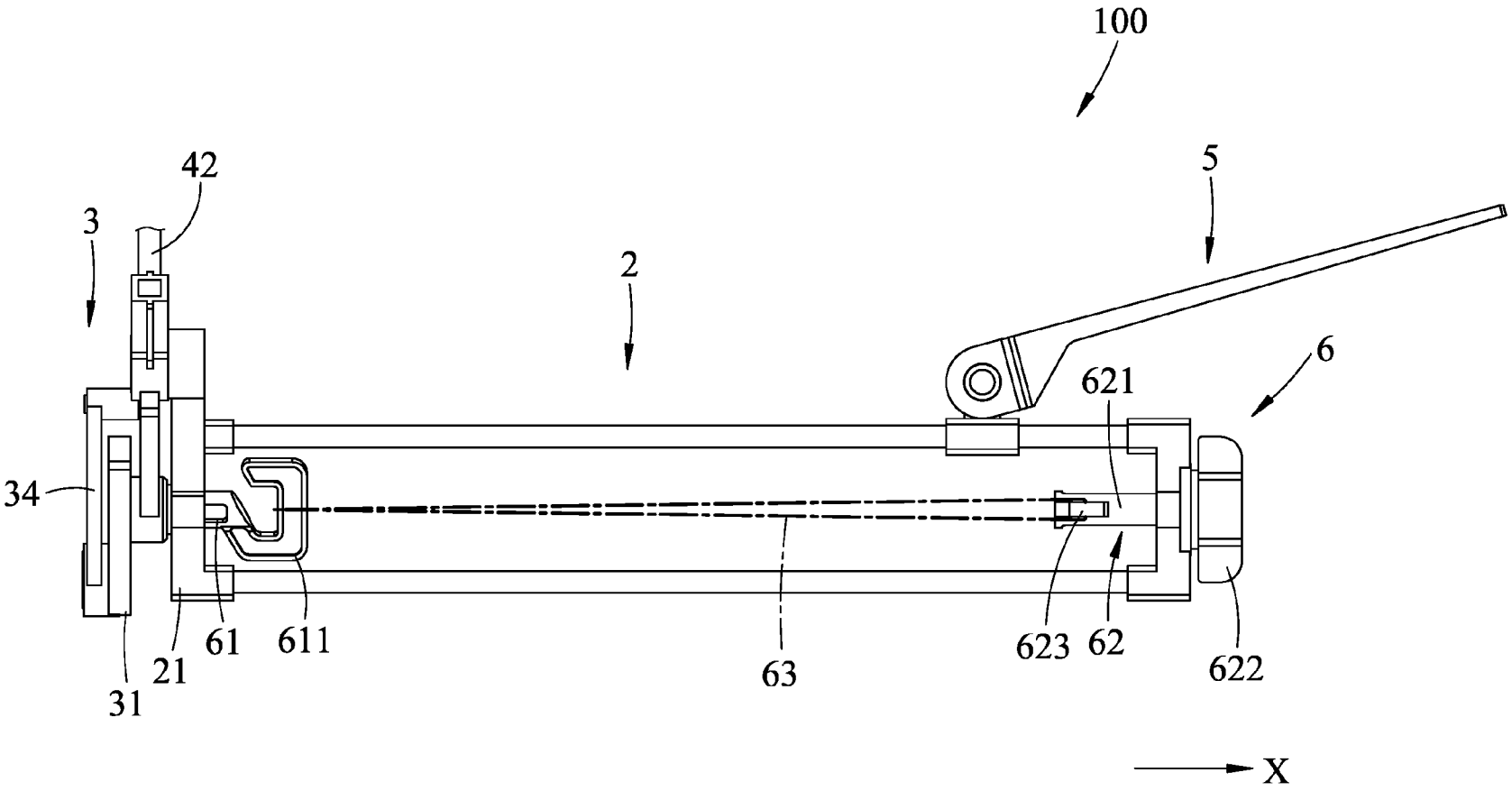
FIG. 6 is a side view of the flying toy according to the first embodiment of the disclosure.

As shown in FIGS. 3 and 4, the transmission mechanism 3 includes first and second gears (i.e., a left sector gear 33 and a right sector gear 32), a left wing connector 35, a right wing connector 36, a crank piece 31, and a crank arm 34.

The left sector gear 33 is mounted pivotally on the left region 212 about a left axis (X1) in the longitudinal direction (X), and has a left toothed segment 331. The left axis (X1) is parallel to the shaft axis (X3).

Figure 7:
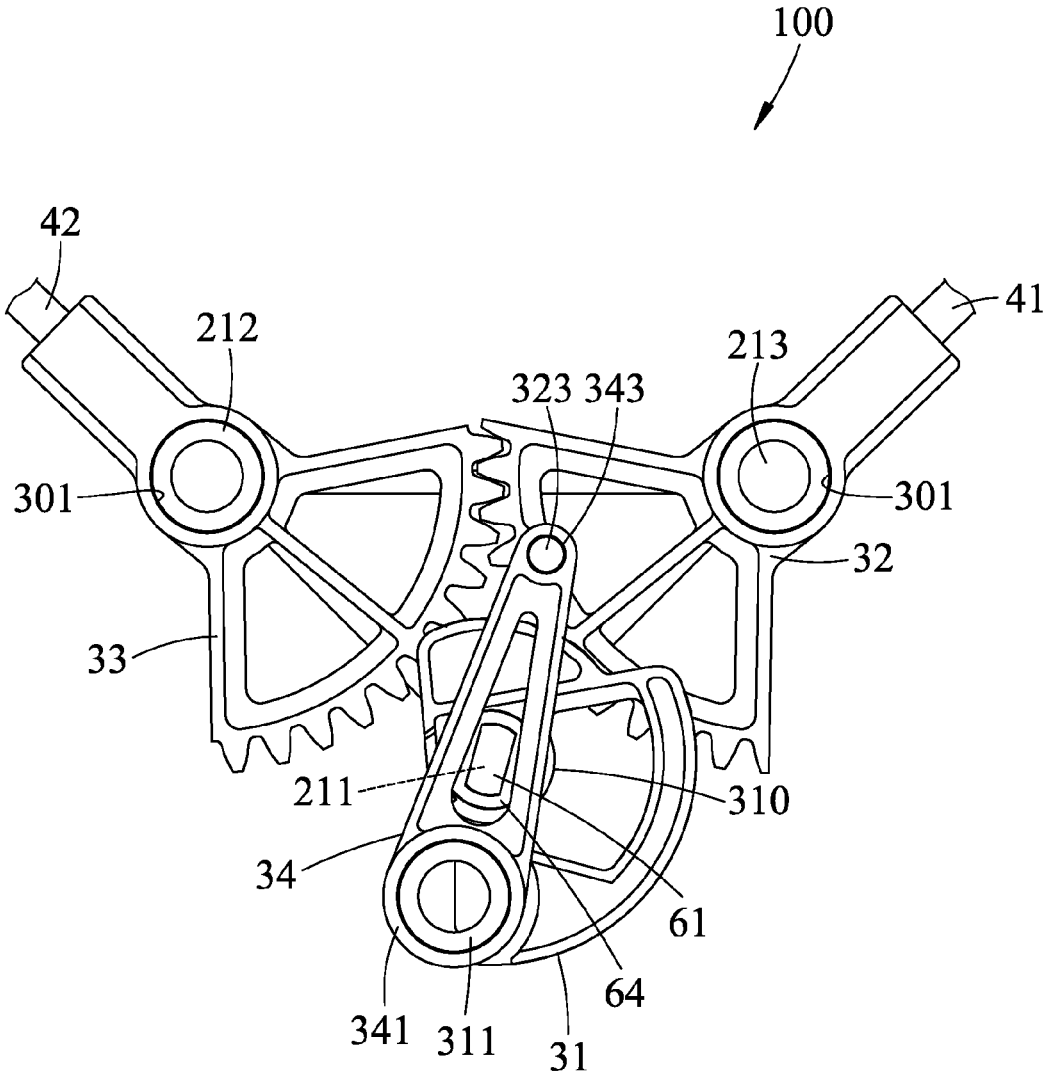
FIGS. 7 and 8 are plan views of a transmission mechanism of the flying toy according to the first embodiment of the disclosure.
Figure 8:
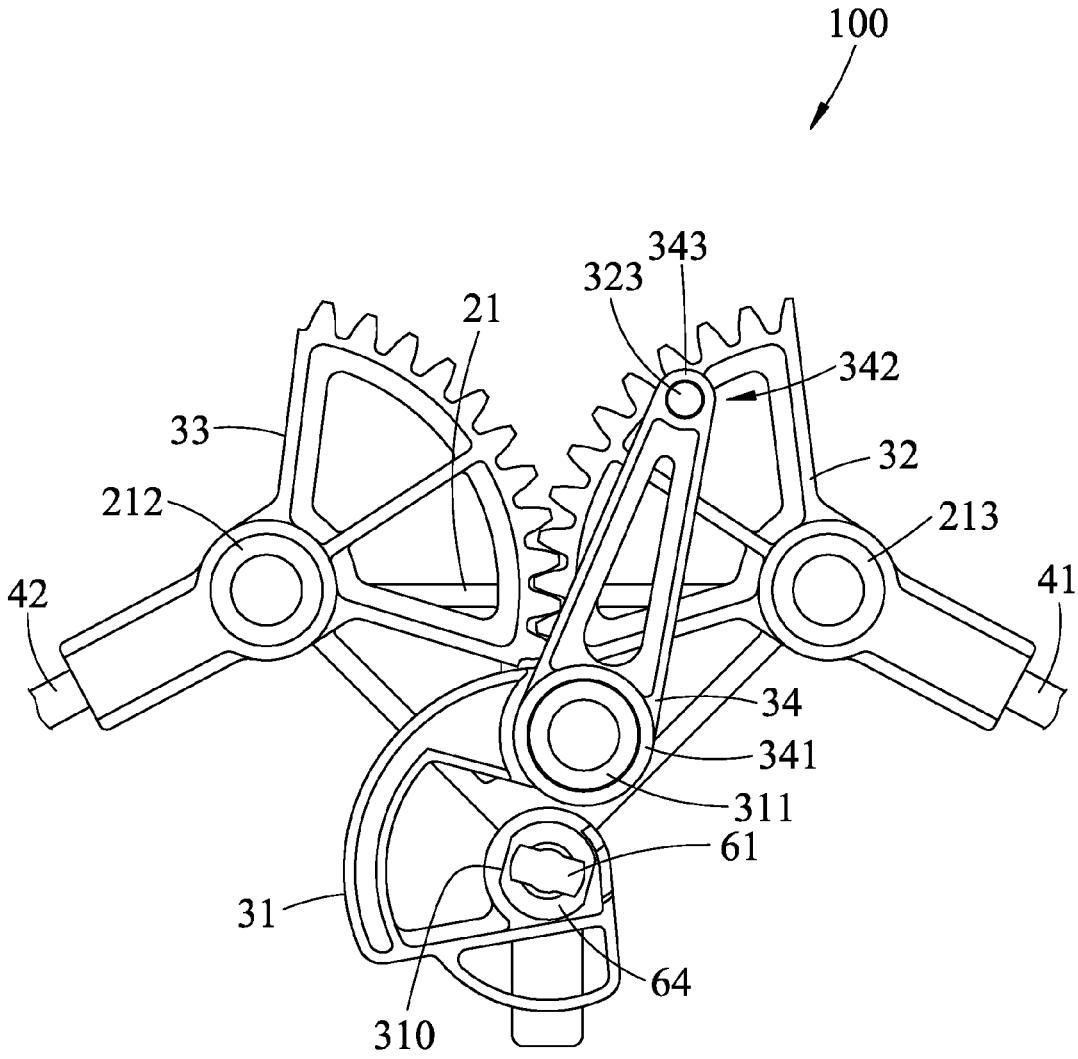

The left wing connector 35 is disposed on the left sector gear 33 and extends radially relative to the left axis (X1) such that when the left sector gear 33 turns clockwise or counterclockwise about the left axis (X1), the left wing connector 35 moves upward or downward, respectively (see FIGS. 7 and 8).

The right sector gear 32 is mounted pivotally on the right region 213 about a right axis (X2) parallel to the left axis (X1), and has a right toothed segment 321 configured to mesh with the left toothed segment 331.

The right wing connector 36 is disposed on the right sector gear 32 and extends radially relative to the right axis (X2) such that when the right sector gear 32 turns clockwise or counterclockwise about the left axis (X2), the right wing connector 36 moves downward or upward, respectively (see FIGS. 7 and 8).

In this embodiment, as best shown in FIGS. 3 and 7, each of the left and right regions 212, 213 is in the form of a tubular stem, and each of the left and right sector gears 33, 32 has a pivot hole 301 configured to permit a corresponding one of the left and right sector gears 33, 32 to be rotatably sleeved on a corresponding one of the left and right regions 212, 213.

The crank piece 31 has a crank region 310 and a connecting region 311. The crank region 310 is rotatably coupled on the first region 211 and is mounted on the drive shaft 61 to rotate therewith about the shaft axis (X3). The connecting region 311 is radially offset from the shaft axis (X3). In this embodiment, the shaft region 211 has a shaft hole 210, and the crank region 310 has a crank hole 300 which is in register with the shaft hole 210. The flying toy 100 further includes a front socket member 64 configured to engage a forward end of the drive shaft 61 and to be fitted into the shaft hole 210 and the crank hole 300 so as to permit the crank piece 31 to rotate with the drive shaft 61.

The crank arm 34 has two opposite end segments (i.e., a downward end segment 341 and an upward end segment 342). The downward end segment 341 is pivotally coupled to the connecting region 311. The upward end segment 342 is pivotally coupled to one of the left and right sector gears 33, 32 at a position proximate to a corresponding one of the left and right toothed segments 331, 321. Therefore, when the crank piece 31 rotates with the drive shaft 61, the downward end segment 341 is rotated about the shaft axis (X3), and the upward end segment 342 is moved upward and downward. When the upward end segment 342 is moved upward, the left sector gear 33 is turned counterclockwise and the right sector gear 32 is turned clockwise. When the upward end segment 342 is moved downward, the left sector gear is turned clockwise and the right sector gear 32 is turned counterclockwise.

In this embodiment, the connecting region 311 is in the form of a tubular stem, and the downward end segment 341 has a first hole 302 configured to permit the downward end segment 341 to be rotatably sleeved on the connecting region 311.

In this embodiment, the upward end segment 342 is pivotally coupled to the right sector gear 32, and has a sleeve portion 343. The right sector gear 32 has a pin portion 323 configured to permit the sleeve portion 343 to be rotatably sleeved thereon.

Figure 9:
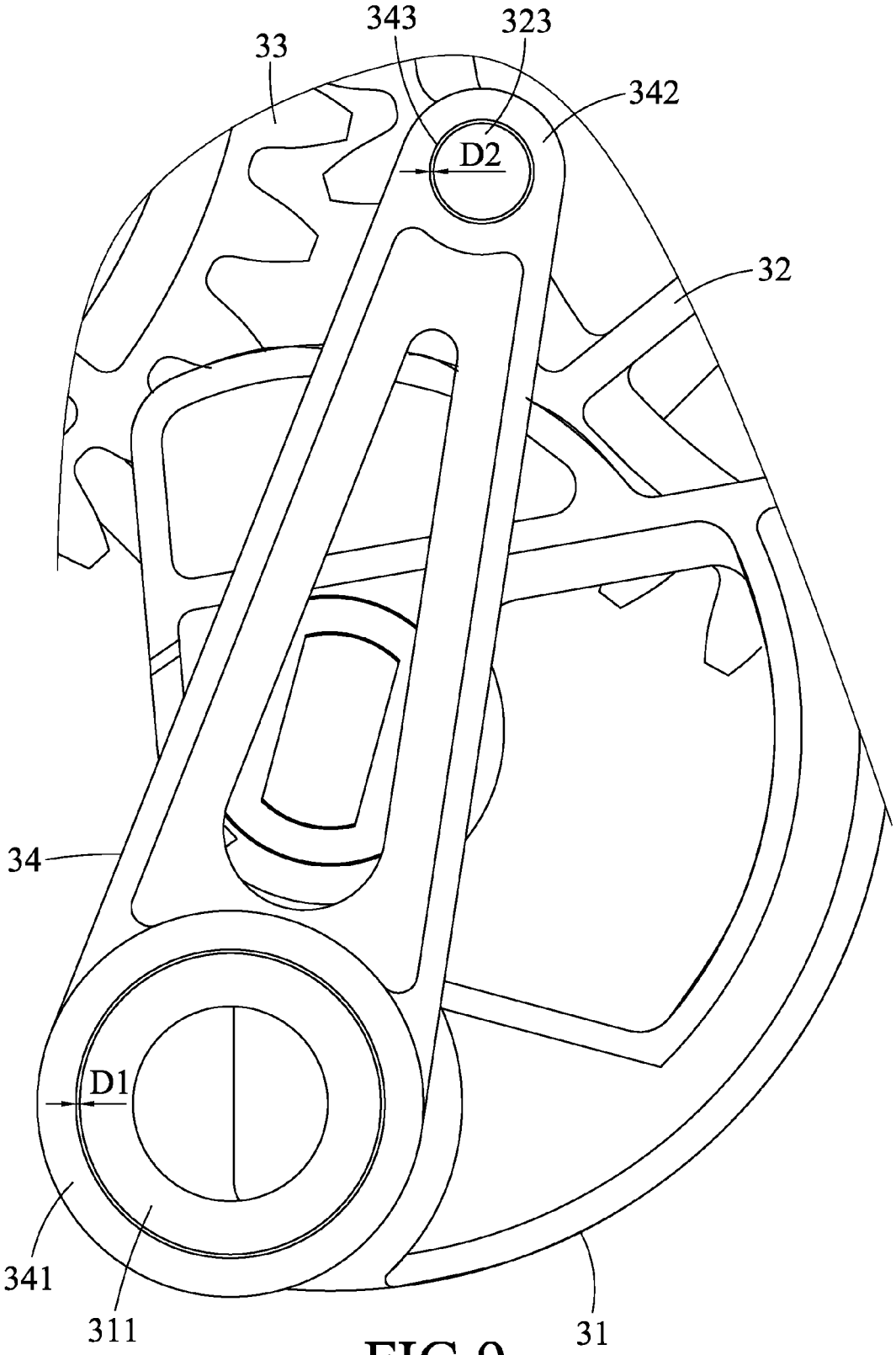
FIG. 9 is a fragmentary enlarged view of the transmission mechanism.

In this embodiment, as shown in FIG. 9, an outer surface of the connecting region 311 and an inner surface of the downward end segment 341 define therebetween a clearance (D1), which reduces contact between the connecting region 311 and the downward end segment 341 to thereby reduce friction resistance therebetween. The sleeve portion 343 and the pin portion 323 defines therebetween a clearance (D2), which reduces contact between the sleeve portion 343 and the pin portion 323 to thereby reduce friction resistance therebetween. Thus, in operation, the movement of the secondary cam arm 34 may be smoother.

The wing unit 4 includes two wing members 41, 42 which are respectively coupled to the first and second gears 33, 32, In this embodiment, each of the wing members 41, 42 is connected to a corresponding one of the left and right wing connectors 35, 36. As shown in FIGS. 4, 7, and 8, because the right toothed segment 321 of the right sector gear 32 is configured to mesh with the left toothed segment 331 of the left sector gear 33, up-and-down movement of the left and right wing connectors 35, 36 can be synchronized to result in a flapping motion of the two wing members 41, 42.

The tail fin 5 is rotatably retained on the elongated support bar 22 at a position distal from the forward end segment 21.

In this embodiment, the flying toy 100 further includes a seat post 51 having a mount end 510 and an insert end 511. The mount end 510 is mounted on the elongated support bar 22. The insert end 511 is opposite to the mount end 510 and includes a left abutment surface 513, a right abutment surface 514, a left tubular stem 515 on the left abutment surface 513, and a right tubular stem 516 on the right abutment surface 514. The tail fin 5 has a left lug 521 with a left lug hole 522 and a right lug 523 with a right lug hole 524. The left and right lugs 521, 523 are spaced apart from each other by a gap 520 which is dimensioned to permit the insert end 511 to be sandwiched between the left and right lugs 521, 523 and to permit the left and right tubular stems 515, 516 to be snap-fitted into the left and right lug holes 522, 524, respectively. Each of the left and right abutment surfaces 513, 514 is formed with a plurality of radial grooves 517. An inner surface of each of the left and right lugs 521, 523 has a protrusion 525 which is configured to engage a selected one of the radial grooves 517 in a corresponding one of the left and right abutment surfaces 513, 514 so as to permit the left and right abutment surfaces 513, 514 to be in rotatable engagement with the left and right lugs 521, 523, respectively.

As shown in FIGS. 3 to 6, the drive unit 6 is configured to drive the drive shaft 61 to rotate about the shaft axis (X3). In this embodiment, the drive unit 6 is a rubber band powered motor and includes a front hook body 611, a rear hook body 623, a rubber band 63 (see FIG. 6), and a drive head 62. Please note that the term "rubber band" as used herein refers to a band which is made from an elastomeric material and which can be twisted to generate a return force (a biasing force).

The front hook body 611 is mounted to the drive shaft 61 opposite to the crank region 310 to permit the drive shaft 61 to rotate with the front hook body 611. The rear hook body 623 is disposed forwardly of the rearward end segment 24. The rubber band 63 is stretched between the front and rear hook bodies 611, 623. The drive head 62 is rotatably retained in the rearward end segment 24, and includes a stem portion 621 and a head portion 622. The stem portion 621 extends from the rear hook body 623 and through the rearward end segment 24. The head portion 622 is disposed rearwardly of the rearward end segment 24 and is configured such that when the front hook body 611 is held against rotation and when the head portion 622 is rotated in a clockwise direction, the rubber band 63 is twisted to generate a biasing force. When the front hook body 611 is released, the biasing force biases the drive shaft 61 to rotate in a counterclockwise direction.

In this embodiment, the rubber band powered motor 6 further includes a ratchet mechanism 66 disposed between the head portion 622 and the rearward end segment 24. The ratchet mechanism 66 includes ratcheting serrations 661 which allow rotation of the head portion 622 in only one direction (e.g., a clockwise direction) and locking serrations 662 which prevent the head portion 622 from rotating in an opposite direction (e.g., a counterclockwise direction).

In this embodiment, the head portion 622 has a through hole 620, and the flying toy 100 further includes a rear socket member 65 configured to engage a rearward end of the stem portion 621 and to be fitted into the through hole 620 so as to permit the stem portion 621 to rotate with the head portion 622.

Figure 10:
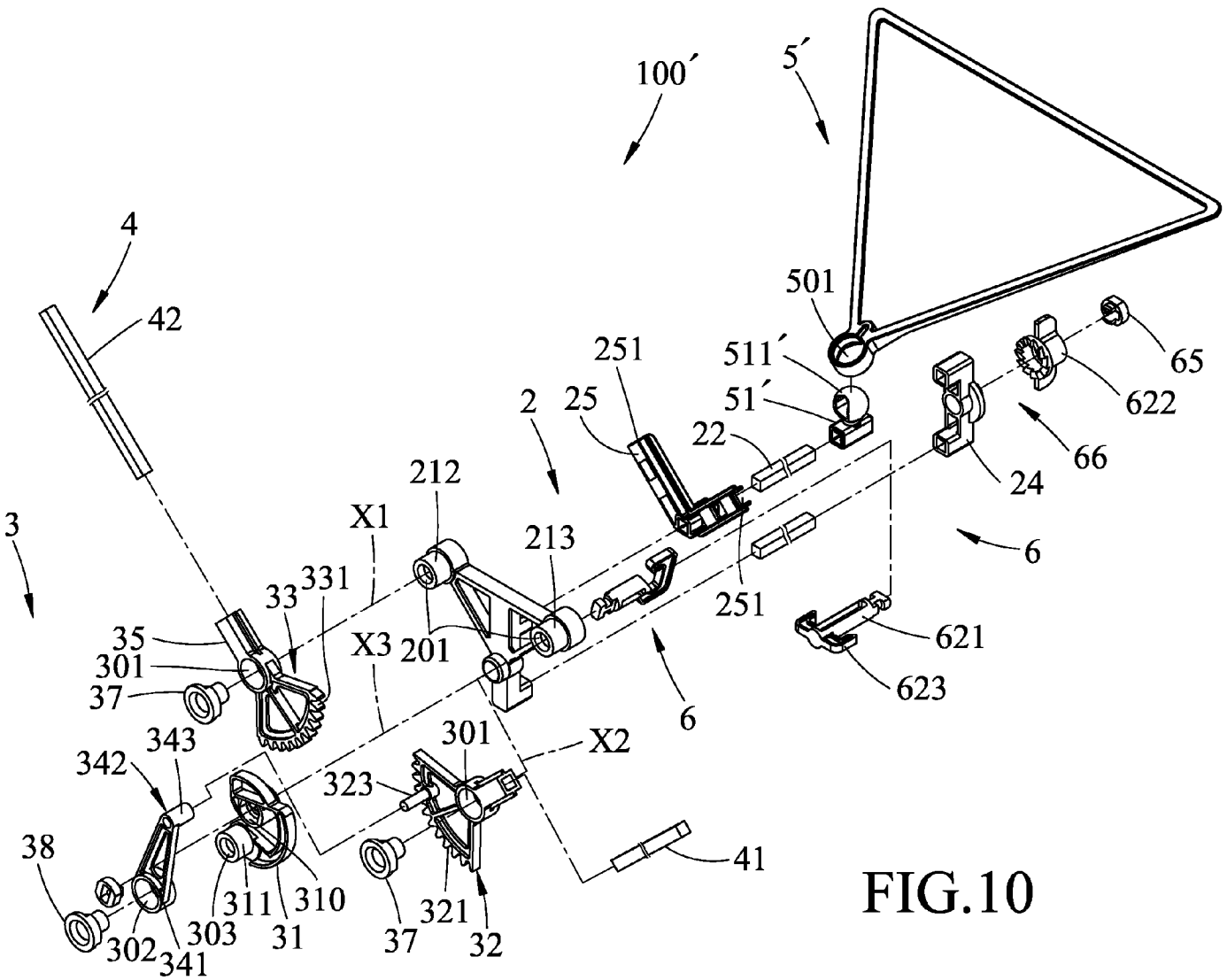
FIG. 10 is an exploded perspective view of a flying toy according to a second embodiment of the disclosure.
Figure 11:
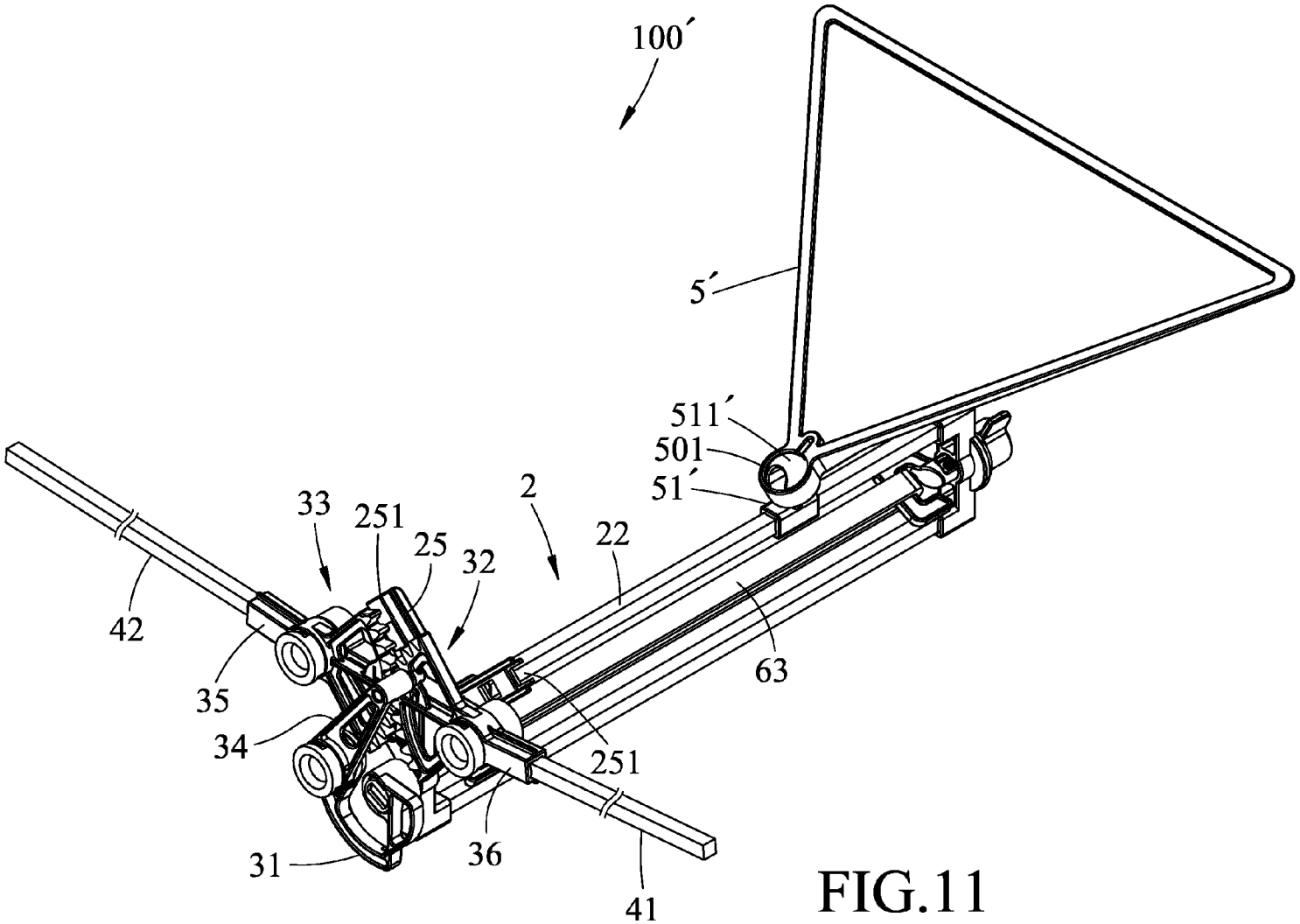
FIG. 11 is a front perspective view of the flying toy according to the second embodiment of the disclosure.
Figure 12:
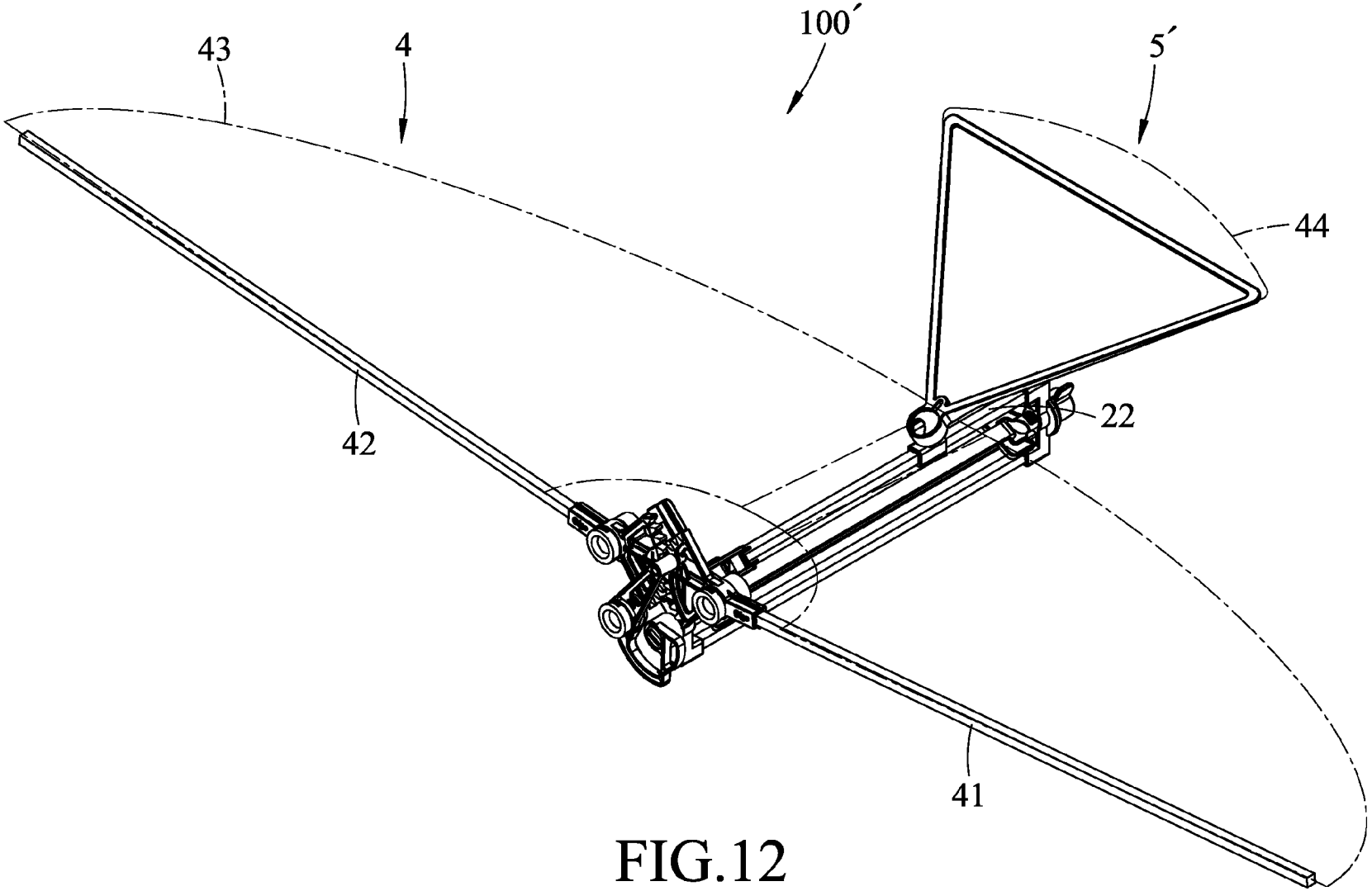
FIG. 12 is similar to FIG. 11 except that two wing webs are shown.

FIGS. 10 to 12 illustrate a flying toy 100' according to a second embodiment of the disclosure. The second embodiment is similar to the first embodiment, except that the support frame 2 of the flying toy 100' further includes a V-shaped frame portion 25 which is mounted on the elongated support bar 22, and which has two end portions 251 configured to be connected to two auxiliary wing members (not shown), respectively.

In the second embodiment, each of the left and right regions 212, 213 has a frame hole 201, and each of the left and right sector gears 33, 32 has a pivot hole 301 in register with the frame hole 201 of a corresponding one of the left and right regions 212, 213. The flying toy 100' further includes two pivot pins 37 each configured to be fitted into the pivot hole 301 of the corresponding one of the left and right sector gears 33, 32 and the frame hole 201 of the corresponding one of the left and right regions 212, 213.

In this embodiment, the connecting region 311 has a second hole 303 in register with the first hole 302 of the downward end segment 341. The flying toy 100' further includes a connecting pin 38 configured to be fitted into the first and second holes 302, 303.

In the second embodiment, the flying toy 100' includes a tail fin 5' and a seat post 51'. The seat post 51' is mounted on the elongated support bar 22 and has an upper rounded end 511'. The tail fin 5' has a socket hole 501 configured to permit the upper rounded end 511' to be snug-fitted therein, thereby forming a ball-and-socket joint.

In addition, as shown in FIG. 12, the wing unit 4 may further include two wing webs 43, 44. The wing web 43 is attached to the wing members 41, 42 and the elongated support bar 22. The wing web 44 is attached to the tail fin 5'.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A flying toy comprising:

a support frame having a forward end segment and a rearward end segment opposite to said forward end segment in a longitudinal direction, said forward end segment having a left region and a right region opposite to said left region in a transverse direction transverse to the longitudinal direction;

a left sector gear which is mounted pivotally on said left region about a left axis in the longitudinal direction, and which has a left toothed segment;

a left wing connector disposed on said left sector gear and extending radially relative to the left axis such that when said left sector gear turns clockwise or counterclockwise about the left axis, said left wing connector moves upward or downward, respectively;

a right sector gear which is mounted pivotally on said right region about a right axis parallel to the left axis, and which has a right toothed segment;

a right wing connector disposed on said right sector gear and extending radially relative to the right axis such that when said right sector gear turns clockwise or counterclockwise about the left axis, said right wing connector moves downward or upward, respectively;

a drive shaft which defines a shaft axis parallel to the left axis, and which is rotatably mounted on said forward end segment;

a crank piece having a crank region which is configured to be mounted on said drive shaft to rotate therewith about the shaft axis, and a connecting region which is radially offset from the shaft axis;

a crank arm having a downward end segment configured to be pivotally coupled to said connecting region, and an upward end segment configured to be pivotally coupled to one of said left and right sector gears at a position proximate to a corresponding one of said left and right toothed segments;

two wing members each being connected to a corresponding one of said left and right wing connectors; and a drive unit configured to drive said drive shaft to rotate about the shaft axis, wherein said right toothed segment is configured to directly mesh with said left toothed segment so as to synchronize up-and-down movement of said left and right wing connectors to thereby result in a flapping motion of said two wing members.

2. The flying toy according to claim 1, wherein said drive unit is a rubber band powered motor.

3. The flying toy according to claim 2, wherein said rubber band powered motor includes a front hook body mounted to said drive shaft opposite to said crank region to permit said drive shaft to rotate with said front hook body, a rear hook body disposed forwardly of said rearward end segment, a rubber band stretched between said front and rear hook bodies, and a drive head which is rotatably retained in said rearward end segment, and which includes a stem portion extending from said rear hook body and through said rearward end segment, and a head portion disposed rearwardly of said rearward end segment, and configured such that when said front hook body is held against rotation and when said head portion is rotated in a clockwise direction, said rubber band is twisted to generate a biasing force to bias said drive shaft to rotate in a counterclockwise direction.

4. The flying toy according to claim 3, wherein said rubber band powered motor further includes a ratchet mechanism disposed between said head portion and said rearward end segment.

5. The flying toy according to claim 1, wherein said forward end segment has a shaft region through which said drive shaft extends, a distance between said shaft region and said left region being substantially the same as a distance between said shaft region and said right region.

6. The flying toy according to claim 5, wherein said shaft region is disposed downwardly of said left and right regions.

7. The flying toy according to claim 1, wherein each of said left and right regions is in the form of a tubular stem, and each of said left and right sector gears has a pivot hole configured to permit a corresponding one of said left and right sector gears to be rotatably sleeved on a corresponding one of said left and right regions.

8. The flying toy according to claim 1, wherein said connecting region is in the form of a tubular stem, and said downward end segment has a first hole configured to permit said downward end segment to be rotatably sleeved on said connecting region.

9. The flying toy according to claim 8, wherein an outer surface of said connecting region and an inner surface of said downward end segment define therebetween a clearance.

10. The flying toy according to claim 1, wherein each of said left and right regions has a frame hole, and each of said left and right sector gears has a pivot hole in register with said frame hole of a corresponding one of said left and right regions, said flying toy further comprising two pivot pins each configured to be fitted into said pivot hole and said frame hole of the corresponding one of said left and right regions.

11. The flying toy according to claim 1, wherein said downward end segment has a first hole, and said connecting region has a second hole in register with said first hole, said flying toy further comprising a connecting pin configured to be fitted into said first and second holes.

12. The flying toy according to claim 1, wherein said upward end segment has a sleeve portion, and said one of said left and right sector gears has a pin portion configured to permit said sleeve portion to be rotatably sleeved thereon.

13. The flying toy according to claim 12, wherein said sleeve portion and said pin portion define therebetween a clearance.

14. The flying toy according to claim 1, wherein said support frame further has an elongated support bar connecting said forward end segment and said rearward end segment, said flying toy further comprising a tail fin which is rotatably retained on said elongated support bar at a position distal from said forward end segment.

15. The flying toy according to claim 14, further comprising a seat post which is mounted on said elongated support bar, and which has an insert end including a left abutment surface, a right abutment surface, a left tubular stem on said left abutment surface, and a right tubular stem on said right abutment surface, said tail fin having a left lug which has a left lug hole and a right lug which has a right lug hole, said left and right lugs being spaced apart from each other by a gap which is dimensioned to permit said insert end to be sandwiched between said left and right lugs and to permit said left and right tubular stems to be snap-fitted into said left and right lug holes, respectively, said left and right abutment surfaces being in rotatable engagement with said left and right lugs, respectively.

16. The flying toy according to claim 14, further comprising a seat post which is mounted on said elongated support bar and which has an upper rounded end, said tail fin having a socket hole configured to permit said upper rounded end to be snug-fitted therein, thereby forming a ball-and-socket joint.

* * * * *